US005803295A

United States Patent [19]

Tussey

[11] Patent Number: 5,803,295

[45] Date of Patent: Sep. 8, 1998

[54] CARGO CARRIER SYSTEM

[76] Inventor: Brian C. Tussey, 242 E. Butternut St. P.O. Box 285, Pine Grove Mills, Pa. 16868

[21] Appl. No.: 648,381

[22] Filed: May 15, 1996

[51] Int. Cl.[6] ..... B65D 27/00

[52] U.S. Cl. ..... 220/4.31; 220/1.5

[58] Field of Search ..... 220/4.31, 682, 220/4.03, 1.5

[56] References Cited

U.S. PATENT DOCUMENTS 3,109,420 11/1963 Ott et al. ..... 220/4.31 X
4,572,368 2/1986 Miller et al. ..... 220/4.03 X
4,809,851 3/1989 Oestreich, Jr. et al. ..... 220/4.31 X
4,936,615 6/1990 Moore ..... 220/1.5 X

*Primary Examiner*—Steven M. Pollard

[57] ABSTRACT

A new "Cargo Carrier System" for offering a cleaner manner of hauling material and things such as sand or dirt, etc. The inventive device includes a box with a floor, a left side, a right side, a back side, and a tail gate. In use, the box 12 of the "Cargo Carrier System" 10 is placed inside a vehicle such as a van, with the tailgate bottom groove 34 adjacent to the rear of the vehicle. The tailgate 30 is then slid down so that the bottom edge of the tailgate 30 is engagedly received by the tailgate bottom groove 34 and the tailgate arms 36 are matingly received by the notches 33 of the left side 20 and the right side 21.

3 Claims, 3 Drawing Sheets

10
36
37
38
39
42
22
30
32
21
34
23
20

10
40
44
22
46
42
21
36
37
32
30
23
20
39

CARGO CARRIER SYSTEM

BACKGROUND OF THE INVENTION

1. Field of the Invention

The present invention relates to passenger vehicle load liners and the like and more particularly pertains to a new "Cargo Carrier System" for offering a cleaner manner of hauling material and things such as sand or dirt, etc.

2. Description of the Prior Art

The use of passenger vehicle load liners and the like is known in the prior art. More specifically, passenger vehicle load liners and the like heretofore devised and utilized are known to consist basically of familiar, expected and obvious structural configurations, notwithstanding the myriad of designs encompassed by the crowded prior art which have been developed for the fulfillment of countless objectives and requirements.

Known prior art passenger vehicle load liners and the like include U.S. Pat. No. 5,419,602; U.S. Pat. No. 5,110,171; U.S. Pat. No. Des. 293,226; U.S. Pat. No. 5,167,433; U.S. Pat. No. 5,322,335 and U.S. Pat. No. 4,877,281.

While these devices fulfill their respective, particular objectives and requirements, the aforementioned patents do not disclose a new "Cargo Carrier System". The inventive device includes a box with a floor, a left side, a right side, a back side, and a tail gate.

In these respects, the "Cargo Carrier System" according to the present invention substantially departs from the conventional concepts and designs of the prior art, and in so doing provides an apparatus primarily developed for the purpose of offering a cleaner manner of hauling material and things such as sand or dirt, etc.

SUMMARY OF THE INVENTION

In view of the foregoing disadvantages inherent in the known types of passenger vehicle load liners and the like now present in the prior art, the present invention provides a new "Cargo Carrier System" construction wherein the same can be utilized for offering a cleaner manner of hauling material and things such as sand or dirt, etc.

The general purpose of the present invention, which will be described subsequently in greater detail, is to provide a new "Cargo Carrier System" apparatus and method which has many of the advantages of the passenger vehicle load liners and the like mentioned heretofore and many novel features that result in a new "Cargo Carrier System" which is not anticipated, rendered obvious, suggested, or even implied by any of the prior art passenger vehicle load liners and the like, either alone or in any combination thereof.

To attain this, the present invention generally comprises a box with a floor, a left side, a right side, a back side, and a tail gate.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new "Cargo Carrier System" apparatus and method which has many of the advantages of the passenger vehicle load liners and the like mentioned heretofore and many novel features that result in a new "Cargo Carrier System" which is not anticipated, rendered obvious, suggested, or even implied by any of the prior art passenger vehicle load liners and the like, either alone or in any combination thereof.

It is another object of the present invention to provide a new "Cargo Carrier System" which may be easily and efficiently manufactured and marketed.

It is a further object of the present invention to provide a new "Cargo Carrier System" which is of a durable and reliable construction.

An even further object of the present invention is to provide a new "Cargo Carrier System" which is susceptible of a low cost of manufacture with regard to both materials and labor, and which accordingly is then susceptible of low prices of sale to the consuming public, thereby making such "Cargo Carrier System" economically available to the buying public.

Still yet another object of the present invention is to provide a new "Cargo Carrier System" which provides in the apparatuses and methods of the prior art some of the advantages thereof, while simultaneously overcoming some of the disadvantages normally associated therewith.

Still another object of the present invention is to provide a new "Cargo Carrier System" for offering a cleaner manner of hauling material and things such as sand or dirt, etc.

Yet another object of the present invention is to provide a new "Cargo Carrier System" which includes a box with a floor, a left side, a right side, a back side, and a tail gate.

Still yet another object of the present invention is to provide a new "Cargo Carrier System" that is light weight and fitted to the available of the vehicle.

Even still another object of the present invention is to provide a new "Cargo Carrier System" that can be repeatedly and quickly put in and taken out of a vehicle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
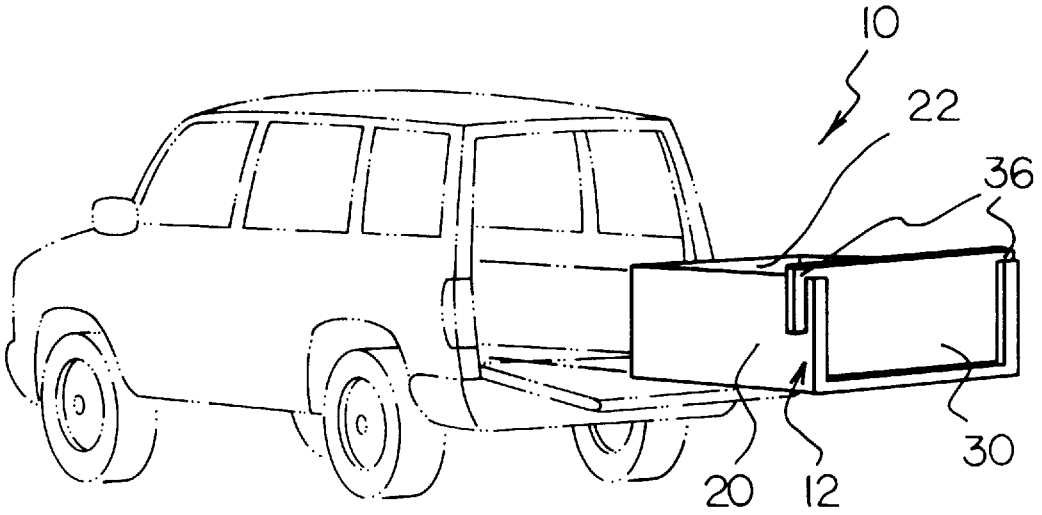
FIG. 1 is a left and front side perspective view of a new "Cargo Carrier System" according to the present invention.
Figure 2:
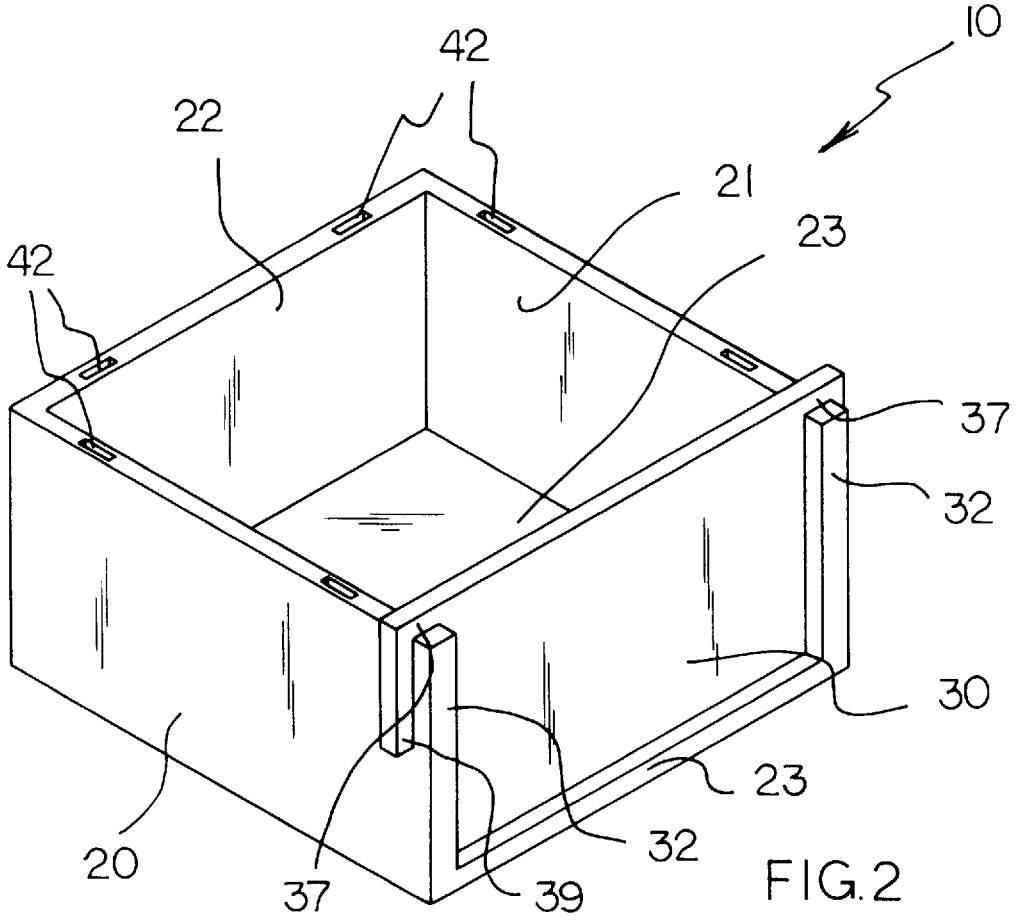
FIG. 2 is an enlarged top, left, and front side perspective view of a new "Cargo Carrier System" according to the present invention.
Figure 3:
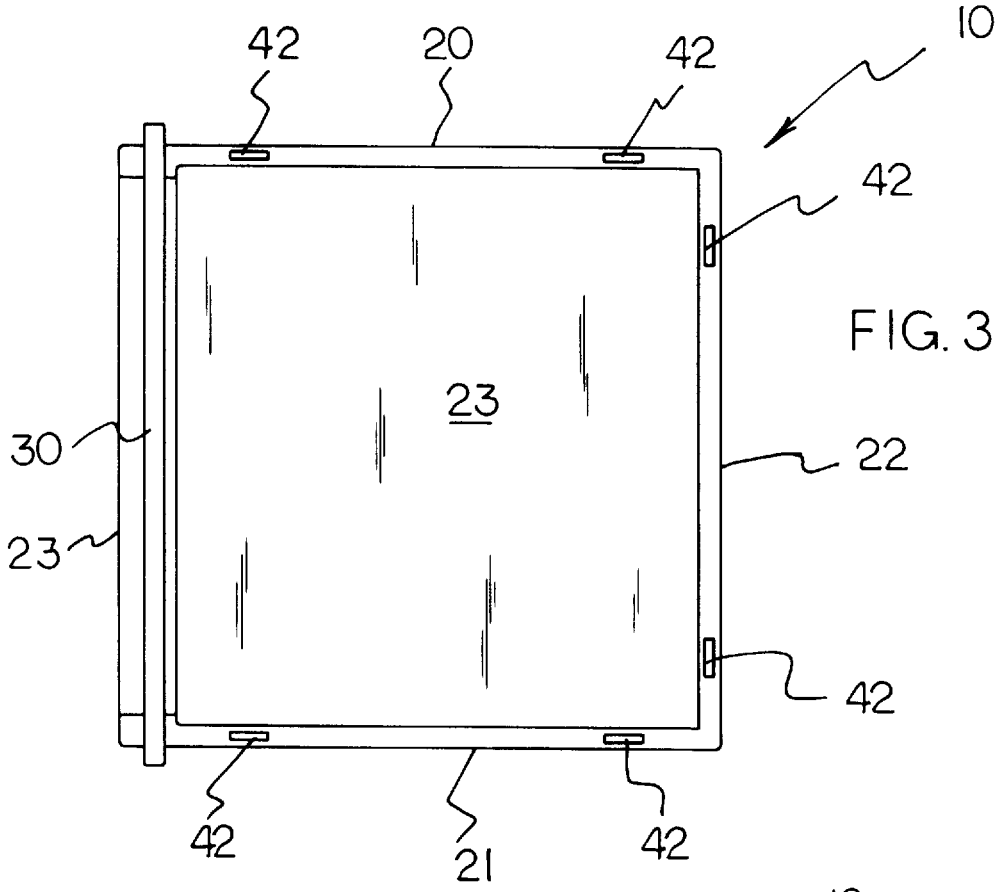
FIG. 3 is a top plan view of the present invention.
Figure 4:
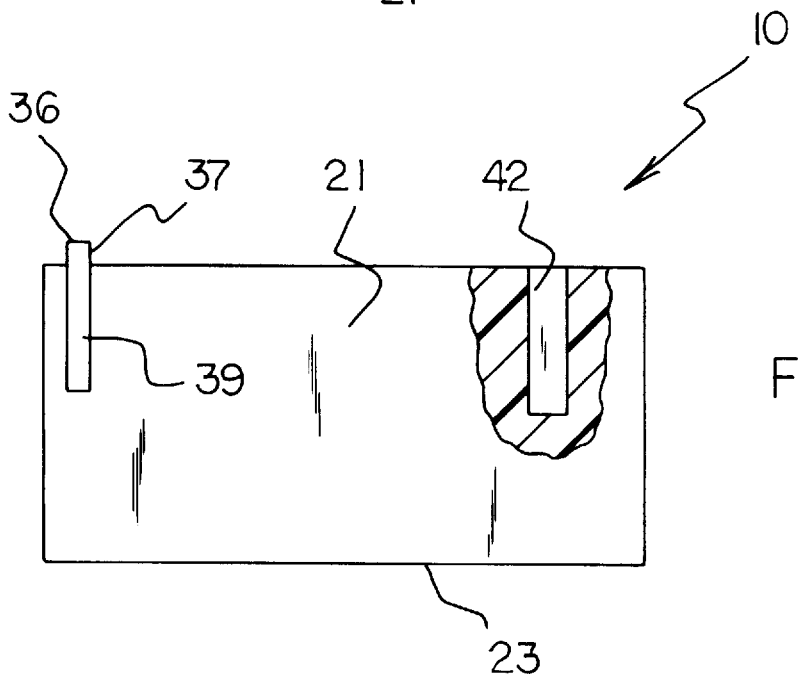
FIG. 4 is a side elevation view and partial cross sectional-detail view of the invention.
Figure 5:
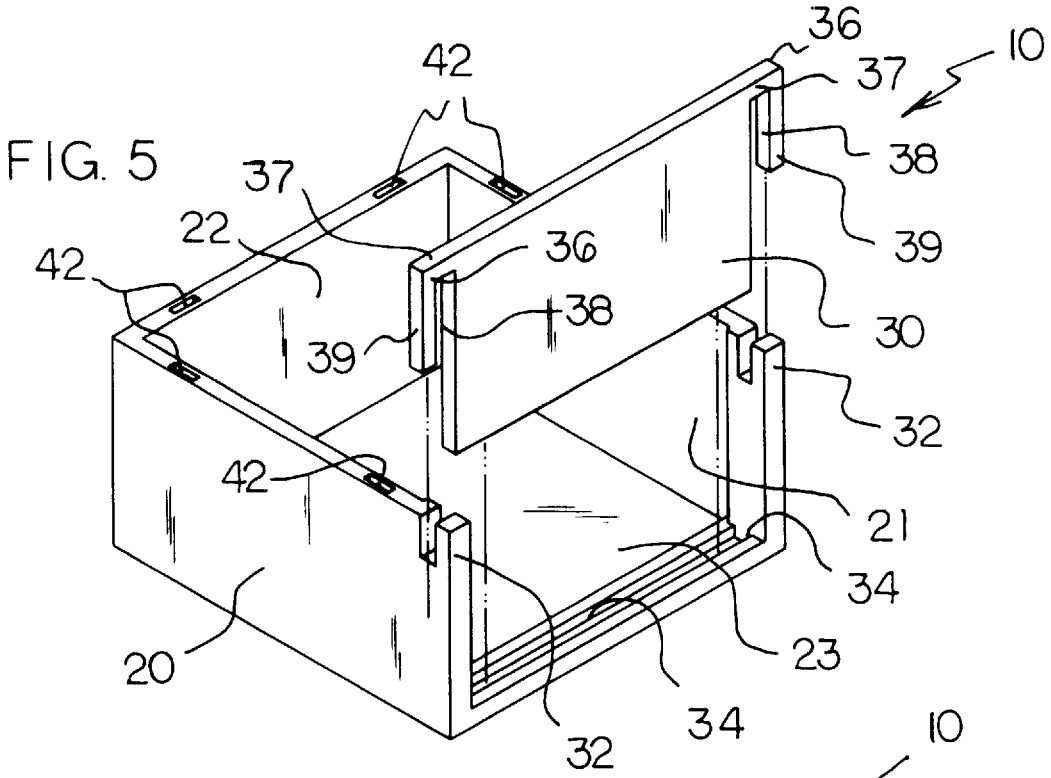
FIG. 5 is an enlarged top, left, and front side perspective view with a raised tail gate of a new "Cargo Carrier System" according to the present invention.
Figure 6:
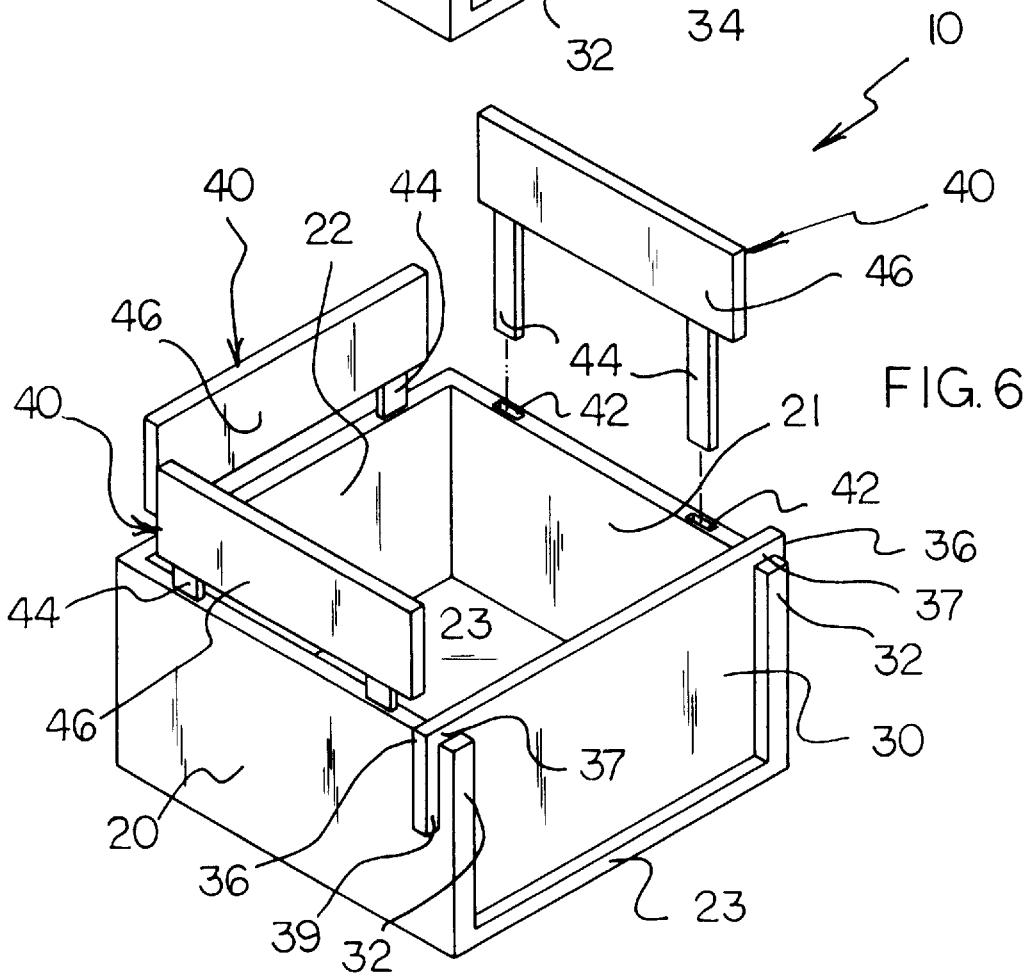
FIG. 6 is an enlarged top, left, and front side perspective view with side board attachments added according to the present invention.

With reference now to the drawings, and in particular to FIGS. 1 through 6 thereof, a new "Cargo Carrier System" embodying the principles and concepts of the present invention and generally designated by the reference numeral 10 will be described.

More specifically, it will be noted that the "Cargo Carrier System" 10 comprises a box 12 with a floor 23, a left side 20, a right side 23, a back side 22, and a tail gate 30 whereby the tailgate 30 is detachable from the box 12 and the left side 20 and the right side 23 include tailgate attachment means 32 that hold the tailgate 30 when it is attached in substantially sealed tight relationship.

As best illustrated in FIGS. 1 through 6, it can be shown that the "Cargo Carrier System" 10 is preferably made of plastic and is constructed so that the left side 20, the right side 21, and the back side 22 all extend up from the floor 23, and are a one piece continuous construction together with the floor 23 whereby the bottom of the left side 20 adjoins the floor 23 on the floor's left side, the bottom of the back side 22 adjoins the floor 23 at the floor's rear side, and the bottom of the right side 21 adjoins the floor 23 on the floor's right side. In addition to this, the rear of the left side 20 adjoins the back side 22 on the back side's left, whereas the rear of the right side 21 adjoins the back side 22 on the back side's right.

The left side 20, the right side 21, and the back side 22 each include a plurality of side board apertures 42 which matingly receive side board stakes 44 of side boards 40. The side boards 40 each include at least one side board stake 44 fixed and protruding out of a horizontal board 46 where the horizontal board 46 is an elongated member and the side board stakes 44 extend down normal to the horizontal board 46.

The tailgate 30 is shaped like a torso with an tailgate arm 36 sticking out each end, and where the tailgate arm 36 includes an upper arm 37 and a lower arm 39 normal to each other, where the upper arm 37 is a horizontal elongation of the tailgate 30 and spaces the lower arm 39 out away from the tailgate 30. The lower arm 39 is a downward elongation of the upper arm 37 and together with upper arm 37, defines an arm pit 38 which matingly receives a similar structure which further comprises the tailgate attachment means 32.

The floor 23, at an end opposite the back side 22, further includes a tailgate bottom groove 34 which matingly receives the lower edge of the tailgate 30 and works with the tailgate arms 36 and the tailgate attachment means 32 in holding and tightly retaining the tailgate in substantially sealed tight relationship.

The left side 20 and the right side 21 each further include a notch which further defines the tailgate attachment means 32. Wherein the notch is matingly similar in structure to the tailgate arm 36 and matingly receives the tailgate arm 36.

In use, the box 12 of the "Cargo Carrier System" 10 is placed inside a vehicle such as a van, with the tailgate bottom groove 34 adjacent to the rear of the vehicle. The tailgate 30 is then slid down so that the bottom edge of the tailgate 30 is engagedly received by the tailgate bottom groove 34 and the tailgate arms 36 are matingly received by the notches 33 of the left side 20 and the right side 21.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A cargo carrier system for removably placing in the rear compartment of a vehicle, comprising:

a box with a floor, a left lateral side, a right lateral side, a back side; said floor, lateral sides and back side formed from a single piece of material such that there are no gaps between said sides and floor through which any material stored in said box may escape from said box into a rear compartment of a vehicle; and a removable tailgate located opposite the back side of said box; and tailgate attachment means for releasably holding the tailgate in a substantially sealed tight relationship with respect to the left and right lateral sides and the floor of said box, wherein said tailgate attachment means comprises tailgate locking means for locking said tailgate in a locked condition on said box, said locking means extending laterally outward from said tailgate to engage the left and right lateral sides of said box, wherein the tailgate locking means comprises a tailgate arm extending laterally outward from each lateral side of said tailgate, and wherein the tailgate arm includes a substantially horizontal upper arm portion and a substantially vertical lower arm portion fixed to said upper arm portion in a substantially normal orientation to said upper arm portion, said upper arm portion spacing the lower arm portion away from the lateral edge of said tailgate to permit a portion of a said lateral side of said box to be trapped between said lower arm portion and said tailgate to hold said tailgate securely to said lateral side, each said lower arm portion extending in substantially the same direction to permit sliding of said tailgate arms over the lateral sides of said box; and receiving means on said left and right lateral sides for receiving the locking means of said tailgate in a manner such that said tailgate may be released from said locked condition by raising said tailgate upwardly and moving said tailgate outwardly from between said left and right lateral sides without requiring the lower edge of said tailgate to be lifted above the upper edges of the lateral sides of said box, wherein the receiving means on each said lateral side comprises an upwardly-opening notch in the upper edge of said lateral side for receiving the upper arm portion of said tailgate arm;

wherein the floor, at an end opposite the back side, further includes a tailgate bottom groove for receiving the lower edge of the tailgate in a substantially sealed tight relationship with said floor when said tailgate is lowered into engagement with said tailgate attachment means to prevent rotation of said tailgate when said tailgate is in said locked condition, and wherein the tailgate bottom groove is located in a raised portion of the upper surface of said floor.

2. The Cargo Carrier System of claim 1, wherein the left lateral side, the right lateral side, and the back side of said box each have an upper edge oriented substantially parallel to said floor, each said upper edge having a side board aperture adapted to matingly receive a side board stake of a side board assembly.

3. The Cargo Carrier System of claim 2, additionally comprising at least one elongate side board assembly having a side board stake for insertion into a said side board aperture, and a side board fixed to said side board stake in a substantial normal orientation to the side board.

* * * * *